US008970447B2

(12) United States Patent
Ochoa et al.

(10) Patent No.: US 8,970,447 B2
(45) Date of Patent: Mar. 3, 2015

(54) DEPLOYABLE HELICAL ANTENNA FOR NANO-SATELLITES

(75) Inventors: Daniel J. Ochoa, Santa Barbara, CA (US); Geoffrey W. Marks, Santa Barbara, CA (US); David J. Rohweller, Ojai, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 468 days.

(21) Appl. No.: 13/564,393

(22) Filed: Aug. 1, 2012

(65) Prior Publication Data

US 2014/0232611 A1 Aug. 21, 2014

(51) Int. Cl.

| | |
|---|---|
| ***H01Q 11/08*** | (2006.01) |
| ***H01Q 1/28*** | (2006.01) |
| ***H01Q 1/12*** | (2006.01) |
| ***H01Q 1/36*** | (2006.01) |

(52) U.S. Cl.

CPC ..... *H01Q 1/1235* (2013.01); *H01Q 1/288* (2013.01); *H01Q 11/086* (2013.01); *H01Q 1/362* (2013.01)

USPC ..... 343/881; 343/880; 343/895

(58) Field of Classification Search

CPC ..... H01Q 1/08; H01Q 1/088; H01Q 1/36; H01Q 11/086; H01Q 3/24; H01Q 1/1235; H01Q 1/362; H01Q 52/108; H01Q 52/645; H01Q 1/288

USPC ..... 343/868, 881, 880, 895, 915; 52/79.5, 52/108, 645, 649.4, 649.5

See application file for complete search history.

(56) References Cited

U.S. PATENT DOCUMENTS

| | | | | |
|---|---|---|---|---|
| 3,836,979 | A * | 9/1974 | Kurland et al. | 343/881 |
| 4,097,867 | A | 6/1978 | Eroncig | |
| 4,161,737 | A | 7/1979 | Albright | |
| 4,780,727 | A * | 10/1988 | Seal et al. | 343/895 |
| 4,819,399 | A * | 4/1989 | Onoda | 52/646 |

(Continued)

FOREIGN PATENT DOCUMENTS

| | | |
|---|---|---|
| JP | 9-326627 A | 12/1997 |
| WO | WO 91/15621 | 10/1991 |

OTHER PUBLICATIONS

Sproewitz, Tom et al. "Deployment Verification of Large CFRP Helical High-Gain Antenna for AIS Signals" IEEE AC Paper, #1568, 2011, 12 pgs.

(Continued)

*Primary Examiner* — Dameon E Levi
*Assistant Examiner* — Jennifer F Hu
(74) *Attorney, Agent, or Firm* — John A. Miller; Miller IP Group, PLC

(57) ABSTRACT

A helical antenna operable to be stowed on and deployed from a cubesat. The antenna includes two helical elements wound in opposite directions and defining an antenna column, where one of the helical elements is a conductive antenna element. The antenna also includes a plurality of circumferentially disposed vertical stiffeners extending along a length of the column and being coupled to the helical elements at each location where the vertical stiffeners and the helical elements cross. The helical elements and the vertical stiffeners are formed of a flexible material, such as a fiber glass, so that the antenna can be collapsed and stowed into a relatively small space. To position the antenna in the stowed configuration, the vertical stiffeners are folded on each other in a radial direction, and then the folded antenna is rolled in an axial direction from one end of the column to the other end.

20 Claims, 2 Drawing Sheets

(56) References Cited

U.S. PATENT DOCUMENTS

| | | | | | |
|---|---|---|---|---|---|
| 5,016,418 | A | * | 5/1991 | Rhodes et al. | 52/646 |
| 5,216,436 | A | | 6/1993 | Hall | |
| 5,246,863 | A | * | 9/1993 | Dahms | 205/788 |
| 5,264,863 | A | * | 11/1993 | Miner et al. | 343/881 |
| 5,345,248 | A | | 9/1994 | Hwang | |
| 5,587,719 | A | | 12/1996 | Steffy | |
| 5,594,461 | A | | 1/1997 | O'Neill, Jr. | |
| 5,721,558 | A | | 2/1998 | Holemans | |
| 5,896,113 | A | | 4/1999 | O'Neill, Jr. | |
| 5,920,292 | A | | 7/1999 | O'Neill, Jr. | |
| 5,923,305 | A | | 7/1999 | Sadler | |
| 5,931,418 | A | * | 8/1999 | Eller et al. | 244/171.8 |
| 5,977,932 | A | * | 11/1999 | Robinson | 343/895 |
| 5,986,619 | A | | 11/1999 | Grybos | |
| 5,992,120 | A | * | 11/1999 | Meguro et al. | 52/653.1 |
| 6,094,178 | A | | 7/2000 | Sanford | |
| 6,169,523 | B1 | | 1/2001 | Ploussios | |
| 6,246,379 | B1 | | 6/2001 | Josypenko | |
| 6,331,838 | B1 | * | 12/2001 | Scott et al. | 343/715 |
| 6,345,482 | B1 | * | 2/2002 | Warren | 52/646 |
| 6,384,798 | B1 | | 5/2002 | Barta | |
| 6,407,720 | B1 | | 6/2002 | Josypenko | |
| 6,920,722 | B2 | * | 7/2005 | Brown et al. | 52/108 |
| 7,183,998 | B2 | | 2/2007 | Wilhelm | |
| 7,414,591 | B1 | | 8/2008 | Lier | |
| 7,474,272 | B2 | | 1/2009 | Lamoureux | |
| 7,586,463 | B1 | | 9/2009 | Katz | |
| 7,694,465 | B2 | * | 4/2010 | Pryor | 52/108 |
| 7,817,101 | B2 | | 10/2010 | Cowles | |
| 2011/0104382 | A1 | * | 5/2011 | Morimoto et al. | 427/446 |
| 2011/0215984 | A1 | | 9/2011 | Coburn | |
| 2011/0248894 | A1 | * | 10/2011 | Crowley et al. | 343/702 |
| 2012/0032847 | A1 | * | 2/2012 | Baktur | 342/365 |

OTHER PUBLICATIONS

Josypenko, Michael J. et al. "Quadrifilar Helical Antenna Array for Line-of-Sight Communications Above the Ocean Surface" NUWC-NPT Technical Report, 11,820, Jun. 25, 2007, 74 pgs.

Wade, Paul, "Helical Feed Antennas" W1GHZ, 1998-2002, 23 pgs.

* cited by examiner

DEPLOYABLE HELICAL ANTENNA FOR NANO-SATELLITES

BACKGROUND

1. Field

This invention relates generally to a helical antenna and, more particularly, to a helical antenna that can be folded both axially and radially into a compact configuration suitable to be stowed on and deployed from a nano-satellite.

2. Discussion

Satellites orbiting the Earth, and other spacecraft, have many purposes, and come in a variety shapes and sizes. One known satellite type is referred to as a cubed nano-satellite (cubesat) that is typically used solely for communications purposes. Cubesats are modular structures where each module (1U) has a dimension of 10 cm×10 cm×10 cm, and where two or more of the modules can be attached together to provide satellites for different uses.

Satellites typically employ various types of structures, such as reflectors, antenna arrays, ground planes, sensors, etc., that are confined within a stowed orientation into the satellite envelope or fairing during launch, and then unfolded or deployed into the useable position once the satellite is in orbit. For example, satellites may require one or more antennas that have a size and configuration suitable for the frequency band used by the satellite. Cubesats typically operate in the VHF or UHF bands. Because cubesats are limited in size, their antennas are required to also be of a small size, especially when in the stowed position for launch. Cubesats have typically been limited to using dipole antennas having the appropriate size for the particular frequency band being used. However, other types of antennas, such as helical antennas, have a larger size, and as thus offer greater signal gain, which requires less signal power for use.

It is known in the art to deploy helical antennas on various types of satellites other than cubesats. Known satellites that employ helical antennas typically have been of a large enough size where the antenna can readily be stowed in a reduced area for launch. However, these helical antennas have typically been confined only in an axial direction, i.e., in a lengthwise direction, for subsequent deployment. For a cubesat, this level of confinement and reduced size for stowing of a helical antenna is unsatisfactory.

DETAILED DESCRIPTION OF THE EMBODIMENTS

The following discussion of the embodiments of the invention directed to a helical antenna capable of being folded in both an axial and radial direction for stowing and launch on a rocket is merely exemplary in nature, and is in no way intended to limit the invention or its applications or uses. For example, the helical antenna described herein has particular application for a cubesat. However, as will be appreciated by those skilled in the art, the helical antenna may have other applications.

Figure 1:
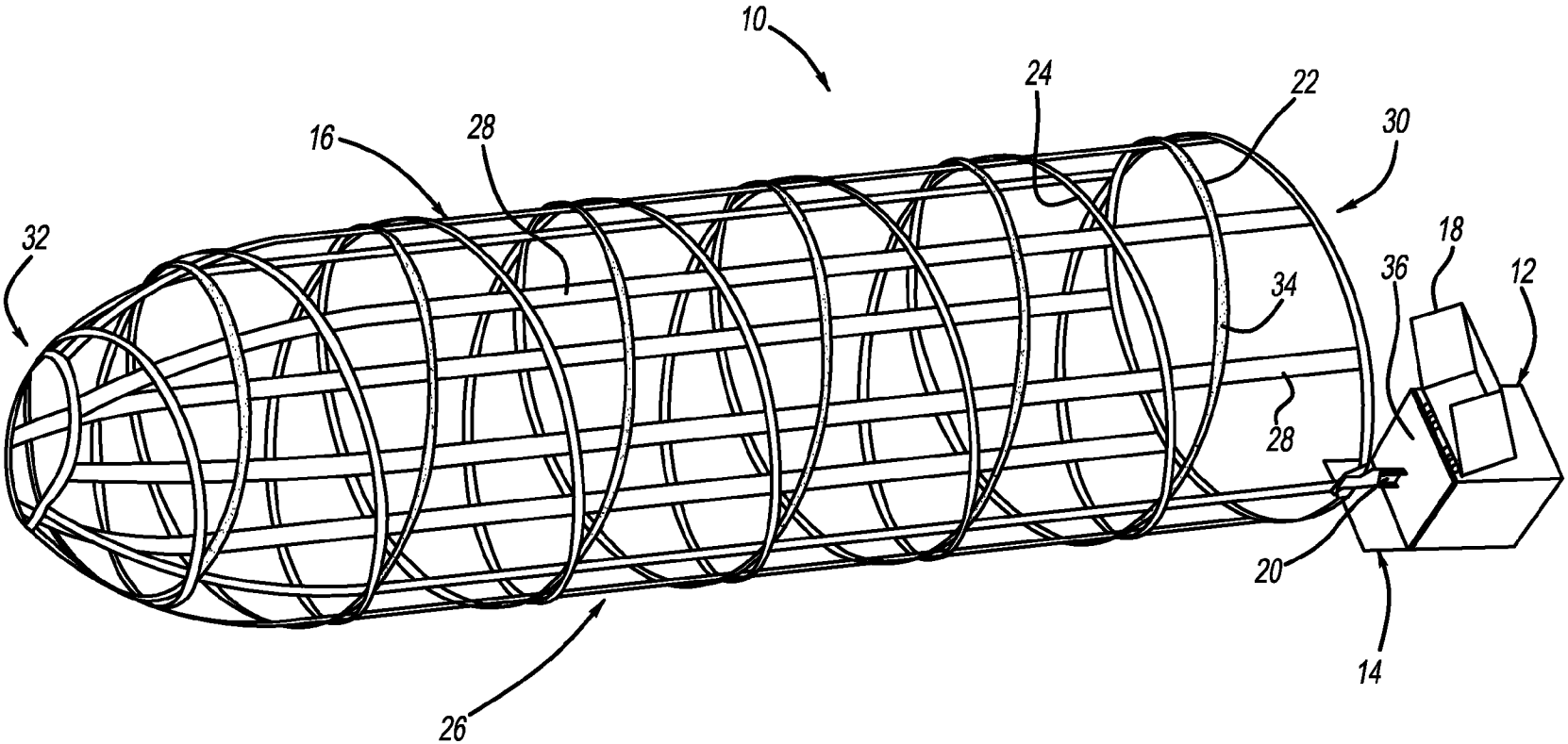
FIG. 1 is a perspective view of a helical antenna mounted to a cubesat and showing a stowage compartment for the antenna.

FIG. 1 is a perspective view of a cubesat 10 including a single modular satellite body 12. In this non-limiting embodiment, the body 12 is a cube having the dimensions of 10 cm×10 cm×10 cm and is of the type where other cubesat bodies can be mounted to the body 12. An antenna deployment box 14 having a cover 18 is mounted to the satellite body 12 in the same manner that other modular bodies would be mounted to the body 12. In this non-limiting embodiment, the deployment box 14 has dimensions of 10 cm×10 cm×5 cm, which is half of the volume of the body 12. A helical antenna 16 is shown extending from the deployment box 14 in its fully deployed position as would occur when the cubesat 10 is operational in space. In this non-limiting embodiment, the cover 18 includes four sides of the deployment box 14. However, other types of deployment boxes having other types of covers will be applicable for stowing the antenna 16. The antenna 16 is attached to an inside surface of a wall 36 of the deployment box 14 that is attached to the body 12 by any suitable mounting structure 20.

As will be discussed in detail below, in order for the helical antenna 16 to be of the size discussed herein to provide the desired antenna performance, and to allow the antenna 16 to be confined and stowed within the deployment box 14 for launch also of the size discussed herein, and for the antenna 16 to properly deploy to the shape shown in FIG. 1, the antenna 16 is configured of certain elements, and is folded in both an axial and radial (cross-section) direction for stowing.

When the antenna 16 is collapsed and confined within the deployment box 14 it has some amount of strain energy so that when the antenna 16 becomes "free" it will "open" using its own stored energy to its deployed orientation as shown in FIG. 1. Various techniques are known in the art to deploy such an antenna from within a deployment box of the type discussed herein, such as using a fuse-type element that when heated, breaks and allows the cover 18 of the deployment box 14 to flip open under a spring force, or some other actuatable mechanism that allows the cover 18 of the deployment box 14 to open causing the antenna 16 to "spring" out using its stored strain energy.

The helical antenna 16 includes a number of elements that are secured together to provide the working antenna element and the structure necessary to support the antenna 16. Particularly, the antenna 16 includes two helical elements 22 and 24 that are wound and intertwined relative to each other to form an antenna column 26, where the helical element 22 is wound in a clockwise direction and the helical element 24 is wound in a counter-clockwise direction. In this non-limiting design, only the helical element 22 is an antenna element that receives and transmits the communications signal, where the helical element 24 is a support element. To provide the necessary electrical conductivity, the helical antenna element 22 is covered with or enclosed within an electrically conductive material, such as a copper tape 34 to provide the conductivity to propagate the signals. In other embodiments, the helical element 22 can be made conductive in other suitable ways. Also, in an alternate embodiment, both of the helical elements 22 and 24 can be antenna elements.

The column 26 formed by the helical elements 22 and 24 is reinforced by a series of vertical stiffeners 28, eight in this non-limiting example, circumferentially disposed around the column 26 and being equally spaced apart to provide axial stiffness. In this non-limiting embodiment, the helical elements 22 and 24 are wound outside of the stiffeners 28. At each location where one of the helical elements 22 or 24 crosses one of the vertical stiffeners 28, those elements are attached to each other so that they retain their desired shape and configuration. Likewise, at those locations where each of the helical elements 22 and 24 cross each other they are attached together. The stiffeners 28 and the elements 22 and 24 can be secured together in any suitable manner, such as by a suitable adhesive or by using heat to bond or weld the stiffeners 28 and the elements 22 and 24. The vertical stiffeners 28 and the helical elements 22 and 24 are configured and mounted together so that a mounting end 30 of the antenna 16 at the deployment box 14 has the same diameter as the column 26 and an opposite deployed end 32 of the antenna 16 has a rounded and tapered configuration.

In one non-limiting embodiment, the length of the vertical stiffeners 28 and the helical elements 22 and 24 is selected and the helical elements 22 and 24 are wound to have about five coils and a 12° pitch so that the length of the column 28 is about 138 cm to provide the desired antenna performance. In one embodiment, all of the helical elements 22 and 24 and the vertical stiffeners 28 are formed of a fiberglass, such as S-2, that is impregnated with a thermoplastic, such as PEEK, that is pultruded to form a material having a thickness of about 5 mils. These materials give the desired flexibility and rigidity necessary to collapse the antenna 16 as discussed herein, and give the collapsed antenna 16 the necessary spring energy to return to the desired deployed shape. However, as will be appreciated by those skilled in the art, other materials may also be applicable to provide these features. Further, in this non-limiting embodiment, the width of the helical elements 22 and 24 is about ¼ of an inch and the width of the vertical stiffeners 28 is about ⅝ of an inch. Also, the copper tape 34 has a thickness of about 3.5 mils.

Figure 2:
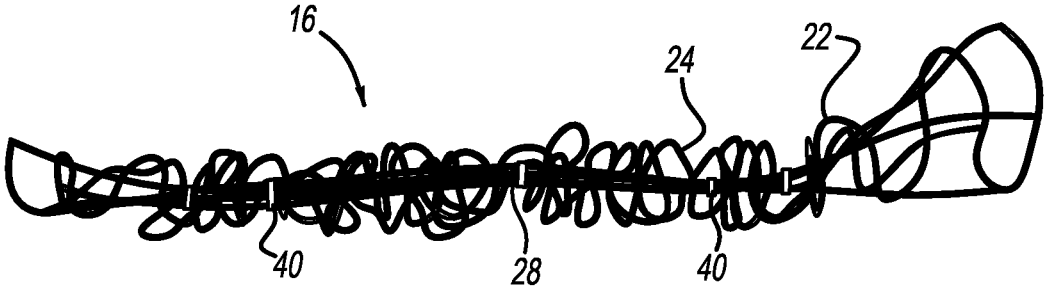
FIG. 2 is a perspective view of the helical antenna separated from the cubesat and being in a partially stowed configuration.

FIG. 2 is a perspective view of the antenna 16 separated from the satellite 10 shown in a partially folded or stowed position in a radial direction. Particularly, the technician that places the antenna 16 in the stowed position in the deployment box 14 will begin by lining up all of the vertical stiffeners 28 so that they are oriented on top of each other and in contact with each other along the length of the column 26. Any suitable tool, fixture or other device can be used to assist the technician in performing this operation. In FIG. 2, the vertical stiffeners 28 are shown being held together by a series of clips 40. The clips 40 would not be part of the structure stowed within the deployment box 14. When the vertical stiffeners 28 are provided in this orientation, the helical elements 22 and 24 are drawn together and extend away from the confined vertical stiffeners 28 in a "rats nest" type orientation.

Figure 3:
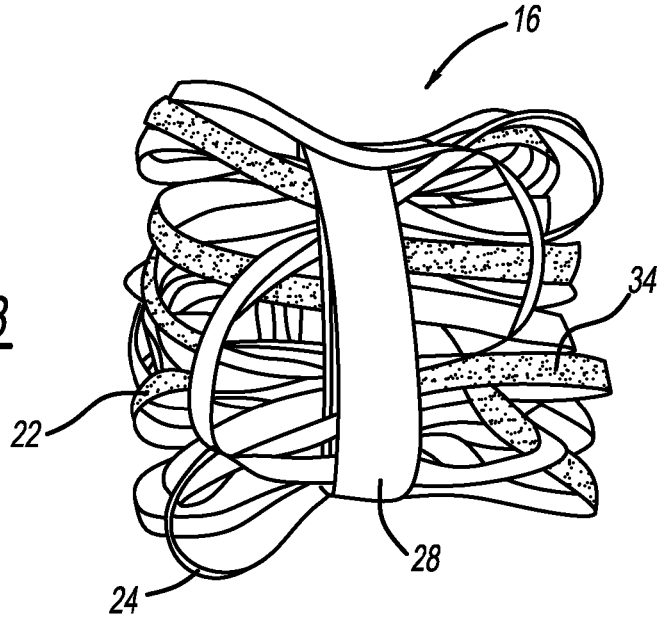
FIG. 3 is a side perspective view of the helical antenna separated from cubesat and being in a fully stowed configuration.
Figure 4:
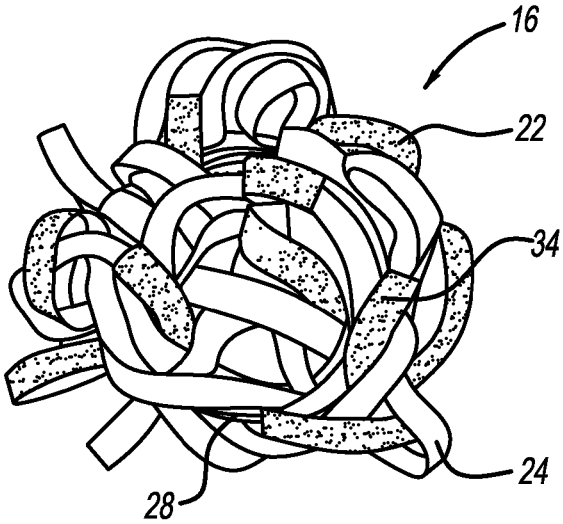
FIG. 4 is an end perspective view of the helical antenna separated from the cubesat and being in a fully stowed configuration.

Once the antenna 16 is held in the radially folded position as shown in FIG. 2, the technician will then roll the flattened and folded antenna element 16 to form a "ball" shape of the antenna 16 as shown in FIGS. 3 and 4 that is the final orientation of the antenna 16 that is then placed in the deployment box 14. The technician can use any suitable tool, fixture or other device to roll the folded antenna 16 to form the antenna ball. For example, the technician can place a cylindrical mandrel (not shown) at an end of the folded column 26 shown in FIG. 2 and roll the antenna 16 lengthwise around the cylindrical mandrel to form the ball shape. In this design, the technician would begin at the rounded end 32 and roll the antenna 16 towards the mounting end 30. Once the antenna 16 is formed into the ball shape, the cylindrical mandrel can be slid out of the confined antenna 16.

FIG. 3 shows the vertical stiffeners 28 being configured on top of each other and being wrapped around the helical elements 22 and 24 so that the helical elements 22 and 24 extend outward, as shown. As the antenna 16 is being folded into the flattened configuration and then rolled into the ball configuration, the helical elements 22 and 24 will collapse onto each other into a relatively tight configuration where they will be extending in various directions. Once the antenna 16 is confined within the deployment box 14, it is under strain, and will quickly deploy to the shape shown in FIG. 1 when the cover 18 of the deployment box 14 is opened. It is noted that the antenna 16 will collapse on itself when under gravity on earth, but in zero gravity of space, the antenna 16 will maintain its desired shape.

The foregoing discussion disclosed and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. An antenna comprising:

a plurality of helical elements defining an antenna column, wherein at least one of the helical elements is an antenna element that is conductive; and a plurality of circumferentially disposed and spaced apart linear stiffener elements extending along a length of the column and being bonded to the plurality of helical elements at each location where the stiffener elements and the helical elements cross, wherein the antenna is configured to be collapsed in both a radial direction and an axial direction where the plurality of linear stiffener elements are aligned and in contact with each other to provide radial collapsing in all radial directions and then rolled to provide axial collapsing.

2. The antenna according to claim 1 wherein the at least one helical element that is the antenna element is covered with a copper tape.

3. The antenna according to claim 1 wherein the plurality of helical elements is two helical elements.

4. The antenna according to claim 3 wherein one of the helical elements is the antenna element and the other helical element is a support element.

5. The antenna according to claim 3 wherein the helical elements are wound in opposite orientations along the column.

6. The antenna according to claim 3 wherein the helical elements each have about five coils, have about a 12° pitch and form the column to be about 12" in diameter.

7. The antenna according to claim 1 wherein the plurality of linear stiffener elements is eight stiffener elements symmetrically disposed around the column.

8. The antenna according to claim 1 wherein the plurality of helical elements and the plurality of linear stiffener elements are configured to form the column to have a tapered and rounded end.

9. The antenna according to claim 1 wherein all of the plurality of helical elements and the plurality of linear stiffener elements are made of a fiber glass impregnated with a PEEK thermoplastic.

10. The antenna according to claim 1 wherein the column is about 138 cm in length and operates in the UHF band.

11. The antenna according to claim 10 wherein the antenna is operable to be used on a cubesat.

12. The antenna according to claim 1 wherein the antenna can be collapsible in both a radial direction and an axial direction to a size of about 10 cm×10 cm×5 cm.

13. A helical antenna to be used on a cubesat, said antenna comprising:

a first helical element and a second helical element wound in opposite orientations and defining an antenna column, wherein the first helical element is an antenna element having a conductive surface and the second helical antenna is a support element; and a plurality of circumferentially disposed and spaced apart linear stiffener elements extending along a length of the column and being bonded to the helical elements at each location where the stiffener elements and the helical elements cross, said antenna being collapsible in both a radial and axial direction to be stowed on the nanosatellite in a deployment box having dimensions of about 10 cm×10 cm×5 cm, wherein the plurality of linear stiffener elements are aligned and in contact with each other to provide radial collapsing in all radial directions and then rolled to provide axial collapsing.

14. The antenna according to claim 13 wherein the first helical element is enclosed within a copper tape.

15. The antenna according to claim 13 wherein the helical elements each have about five coils, have about a 12° pitch and form the column to be about 12" in diameter and about 138 cm in length.

16. The antenna according to claim 13 wherein the plurality of linear stiffener elements is eight stiffener elements symmetrically disposed around the column.

17. The antenna according to claim 13 wherein all of the plurality of helical elements and the plurality of linear stiffener elements are made of a fiber glass impregnated with a PEEK thermoplastic.

18. A method for stowing an antenna in a confined space, said method comprising:

providing the antenna to have two helical elements that are wound in opposite directions relative to each other to define an antenna column and a plurality of circumferentially disposed linear stiffener elements extending along a length of the column and being bonded to the helical elements at each location where the stiffener elements and the helical elements cross;

folding the antenna in a radial direction so that the plurality of circumferentially disposed linear stiffener elements are aligned and in contact with each other along the column to provide folding in all radial directions;

rolling the radially folded antenna column in an axial direction from one end of the column to an opposite end of the column; and placing the folded and rolled antenna into a deployment box.

19. The method according to claim 18 wherein providing the antenna includes forming the two helical elements and the linear stiffener elements as a tape from a fiber glass impregnated with a PEEK thermoplastic.

20. The method according to claim 18 wherein the antenna column is about 138 cm long and about 12" in diameter when in the unfolded and unrolled orientation and is about 10 cm×10 cm×5 cm in the folded and rolled orientation.

* * * * *